US005218958A

United States Patent [19]

Cooper

[11] Patent Number: 5,218,958

[45] Date of Patent: Jun. 15, 1993

[54] PLACENTAL CHAMBER - ARTIFICIAL UTERUS

[76] Inventor: William I. Cooper, 300 N. Fourteenth St., Easton, Pa. 18042

[21] Appl. No.: 658,698

[22] Filed: Feb. 21, 1991

[51] Int. Cl.[5] ..... A61G 10/00; A61G 11/00; A62B 31/00; A62B 7/00

[52] U.S. Cl. ..... 128/205.26; 128/202.13; 600/22

[58] Field of Search ..... 604/289, 290; 600/20, 600/21, 22; 128/202.12-202.16, 205.26

[56] References Cited

U.S. PATENT DOCUMENTS

| | | | |
|---|---|---|---|
| 2,508,050 | 5/1950 | Valente | 128/205.26 |
| 2,723,660 | 11/1955 | Greenberg | 600/21 |
| 3,777,507 | 12/1973 | Burton et al. | 600/22 |
| 3,858,570 | 1/1975 | Beld et al. | 600/22 |
| 4,681,090 | 7/1987 | Koch | 600/22 |
| 4,850,997 | 7/1989 | DuBose | 604/289 |

FOREIGN PATENT DOCUMENTS

| | | | |
|---|---|---|---|
| 164040 | 9/1949 | Austria | 600/22 |
| 567038 | 5/1958 | Belgium | 128/205.26 |

*Primary Examiner*—Edgar S. Burr
*Assistant Examiner*—Kimberly L. Asher
*Attorney, Agent, or Firm*—Pollock, Vande Sande & Priddy

[57] ABSTRACT

Life support system for a premature baby which remains attached to its placenta through its umbilical cord. The system includes upper and lower chambers separated by a dome-like partition. The lower chamber contains physiological liquid in which the baby is suspended, and the upper chamber contains an oxygen-containing atmosphere and a supply of nutrients for contact with the placenta which rests on the top of the dome-like partition.

4 Claims, 1 Drawing Sheet

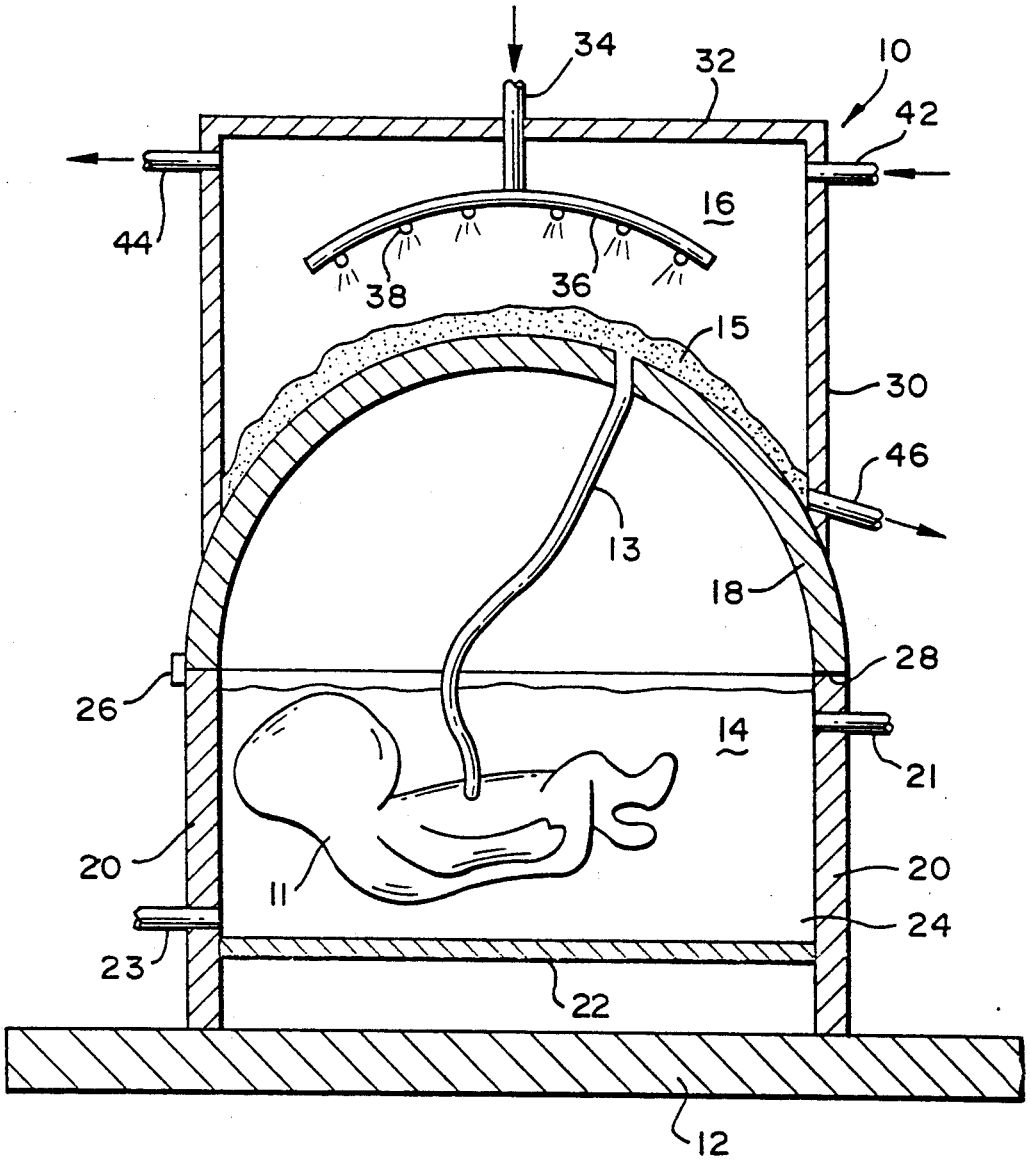
34
32
10
42
44
16
38
36
15
30
46
13
18
28
26
14
21
20
11
20
24
23
22
12

PLACENTAL CHAMBER - ARTIFICIAL UTERUS

The present invention relates to apparatus for supporting the life of a prematurely-born baby.

BACKGROUND OF THE INVENTION

Babies which are born after about a 10 week gestation period typically are capable of functioning independently of the mother from a hormonal standpoint, and at this stage the only maternal functions are to supply oxygen and nutrients to the fetus and to remove waste byproducts such as uric acid. However, until about 28 weeks, lungs are not sufficiently developed to support the baby; consequently, babies born before ; the 28th week of gestation, as by irreversible premature labor, have little chance to survive.

SUMMARY OF THE INVENTION

It is accordingly one object of this invention to provide a system for supporting the life of a baby which is born too prematurely to have functioning lungs.

It is another object to provide a system which provides a fetus with an artificial environment which mimics the baby's prebirth environment.

Other objects of this invention will be apparent from the following description and the claims appended hereto.

In accordance with this invention there is provided a life support system for a premature human baby, in which the baby remains attached to its placenta through its umbilical cord. The system comprises upper and lower enclosed chambers and a dome-like member positioned between the two chambers. The lower chamber comprises a tank having a bottom wall and side walls for holding physiological fluids in which the baby is suspended. A dome-like cover is hingedly connected to the side walls of the lower chamber, the dome-like cover having a convex upper surface adapted for supporting the placenta in a layer-like arrangement and a passageway therethrough for the umbilical cord which extends upwardly from the lower chamber into the upper chamber. The upper chamber includes oxygen-supply means for maintaining an oxygen-containing atmosphere therein, and nutrient supply means for introducing aqueous nutrient-containing media into contact with the placenta resting on the convex surface of the cover.

This invention takes advantage of the functions of the placenta and the umbilical cord and mimics the function of the mother's uterus in supplying nutrients and oxygen to the baby through the placenta and the umbilical cord.

BRIEF DESCRIPTION OF THE DRAWING

The Figure is a vertical view of one embodiment of the present invention.

DETAILED DESCRIPTION OF THE INVENTION

This invention takes advantage of the changes in maternal functions with respect to the fetus as the fetus develops. The ovary supports the pregnancy for the first couple of months, producing progesterone. At a gestation period of about 10 weeks, the baby and placenta are substantially independent of external hormonal input, and the only maternal functions are (1) oxygenation of the placenta and (2) nutrition of the infant with removal of subsequent waste products, such as uric acid. The uterus performs these functions by providing a continuous flow of blood over the placenta, pulsatile with the maternal heartbeat, from the arterials of the inner surface of the uterus. This blood is squirted directly onto the placenta where a very thin layer (just a few cells thick) separates the maternal blood from the capillary blood of the baby, and the nutrients and oxygen diffuse through the placental membrane into the fetal circulation system.

Fetal blood is circulated by the fetal heartbeat and is continuous. The fetus also urinates and is developing a normal kidney function, thus providing its own method of cleansing its blood of toxins.

The present invention replaces the functions of the uterus after the baby and placenta have been surgically removed by hysterectomy in a sterile environment. This procedure may be followed in those cases in which intrauterine development is no longer possible, as, for example, in the case of irreversible premature labor during the second trimester of pregnancy. It is essential that the baby not begin spontaneous respiration, which would cause the placental circulation to be replaced by the infant's circulation.

In the embodiment of the present invention shown in the Figure, a life support system 10 for a baby 11 includes a base 12, a lower chamber 14, upper chamber 16, and a dome 18 which separates the two chambers. Lower chamber 14 is defined by bottom wall 22, side walls 20 and the lower surface of dome 18. Upper chamber 16 is defined by side walls 30, top wall 32 and the upper surface of dome 18. Upper chamber 16 provides an airtight and watertight seal at the point of contact between wall 30 and the lower edge 28 of dome 18 which is hinged to wall 20 by a hinge 26. An elastomeric seal member (not shown) is present at the point of contact in the preferred embodiment of the present invention. Upper and lower chambers 16, 14, respectively, and the dome 18 separating the two chambers may be made of a variety of materials which are inert to the materials in contact with the chamber and dome. The preferred materials are transparent and most preferable are transparent plastics.

In the preferred embodiment of the present invention, upper and lower chambers 16, 14 have cylindrical side walls and the dome-like structure 18 separating the two chambers is substantially hemispherical in shape. As shown in the Figure, the lower part of lower chamber 14 contains physiological fluid 24 for suspended baby 11 which remains connected to placenta 15 through umbilical cord 13. An inlet 21 and an outlet 23 are provided for introducing physiological fluid into and removing physiological fluid from chamber 14. Base 12 is provided with thermal control means (not shown) for keeping the entire unit at body temperature.

The physiological fluid 24 is a salt solution which serves the functions that the amniotic fluid serves in a normal pregnancy and preferably has substantially the same composition. Solutions which mimic the amniotic fluid, such as for example, lactated ringers solution, are known.

The flow rate of the physiological fluid 24 into and out of chamber 14 is not critical and a flow rate of about one liter per hour may be used.

Placenta 15 is placed over the dome-like structure 18 so as to mimic its normal position against the wall of a rounded uterus. In this position, the placenta is optimally exposed to oxygen and nutrients. The gas in chamber 16 is preferably substantially 100% oxygen for oxygenating the placenta. Oxygen in a low continuous flow, for example, about 1 liter per minute is introduced into chamber 16 through gas inlet 42 and a mixture of oxygen and carbon dioxide which diffuses out of the placenta is removed from chamber 16 through gas outlet 44.

It is essential that the surface of the placenta 15 be moist at all times since dehydration or desiccation of tissues would kill at least the surface cells. Nutrient medium is introduced into the chamber through nutrient inlet 34 which leads nutrient to spray nozzles 38 through rotating arm 36. The rotation of arm 36 mimics the action of arterials squirting blood onto the placenta because as arm 36 rotates, any individual area on the placenta would only be struck intermittently by nutrients from nozzle 38. The flow rate of nutrient medium may simulate ranges from, about 200 to about 1000 ml per minute depending on the size of the baby. The liquid pressure within the rotating arm is low (approximately 10 mm of mercury maximum) in order to mimic the low liquid pressure in the arterials.

Medium at least partially depleted in nutrients by transfer thereof, to the placenta is removed from chamber 16 through nutrient outlet 46.

A suitable nutrient medium composition is one which is equivalent to nutrient medium composition given in feeding patients intravenously by hyperalimentation. It may be practical to recirculate nutrient medium before replacing it, depending on the uptake of the nutrients as well as accumulation of toxic byproducts from the placenta.

In using this device it is essential that the interior of the apparatus be sterile, and it is preferred that antibiotics be present in the nutrient medium to prevent infection.

What is claimed is:

1. A life support system for a premature human baby, said baby remaining attached to its placenta through its umbilical cord, said system comprising:

(a) a lower chamber comprising a tank for suspending the baby in physiological fluids, said tank having a bottom wall and side wall(s);

(b) an upper chamber positioned above said lower chamber, said upper chamber having side walls and including means for introducing oxygen and for maintaining an oxygen-containing atmosphere therein, and means for introducing aqueous nutrient-containing media therein for contacting the placenta; and, (c) a dome-like cover having an upper surface sealingly engaging said side walls of said upper chamber, removably secured to said side walls(s) of said lower chamber, said dome-like cover having a convex upper surface adapted for supporting the placenta in a layer-like arrangement, said cover further having an opening for passing the umbilical cord upwardly into said upper chamber from said lower chamber.

2. A life support system according to claim 1 wherein said means for introducing oxygen into said upper chamber comprises means for maintaining substantially pure oxygen within said upper chamber.

3. A life support system according to claim 1 wherein said dome-like cover is substantially a hemisphere and said side walls of said upper and lower chambers are cylindrical.

4. A life support system according to claim 1 wherein said aqueous media introducing means comprises means for spraying said aqueous media into said chamber.

* * * * *